US006964407B1

(12) United States Patent
Butler

(10) Patent No.: US 6,964,407 B1
(45) Date of Patent: Nov. 15, 2005

(54) MANHOLE COVER LIFTER

(76) Inventor: Ted A. Butler, 1508 3rd St., Daphne, AL (US) 36526

( * ) Notice: Subject to any disclaimer, the term of this patent is extended or adjusted under 35 U.S.C. 154(b) by 24 days.

(21) Appl. No.: 10/877,168

(22) Filed: Jun. 28, 2004

(51) Int. Cl.[7] ..... B66F 3/00
(52) U.S. Cl. ..... 254/131
(58) Field of Search ..... 254/131, 131.5, 254/132, 120; 294/17

(56) References Cited

U.S. PATENT DOCUMENTS 824,041 A * 6/1906 Pilliner ..... 157/1.17
1,933,384 A 10/1933 Moyian
2,655,399 A * 10/1953 McMillan ..... 294/17
2,832,628 A * 4/1958 Turnbull ..... 294/17
3,985,338 A 10/1976 Herrmann
4,157,810 A 6/1979 Haller et al.
4,365,925 A 12/1982 Girtz
4,482,182 A 11/1984 Mortensen
4,991,893 A * 2/1991 Gordon et al. ..... 294/17
5,775,674 A 7/1998 Bigham
6,290,211 B1 * 9/2001 Pheiffer ..... 254/132
6,439,628 B1 8/2002 Eslambolchi et al.

* cited by examiner

*Primary Examiner*—Lee D. Wilson
(74) *Attorney, Agent, or Firm*—George L. Williamson

(57) ABSTRACT

The present invention discloses a lifter for a manhole cover which has an elongated arm having a handle on one end for being grasped and lifted upwardly by a user and on the other end a pair of hooks for placement on or under the edge of the manhole cover. Disposed intermediate the ends of the handle is a slidable downwardly extending hook member which is for placement on the side of the manhole cover opposite to the side of the manhole cover where the hooks are placed. The downwardly extending hook member is slidable along the handle so that the present invention will fit any size of manhole cover. Also disposed on the handle is a clip which locks the downwardly extending hook member in place along the handle for storage.

6 Claims, 1 Drawing Sheet

MANHOLE COVER LIFTER

BACKGROUND OF THE INVENTION

1. Field of the Invention

The present invention relates generally to lifters and, more particularly, is concerned with a lifter for a manhole cover.

2. Description of the Prior Art

Manhole cover lifters have been described in the prior art; however, none of the prior art devices disclose the unique features of the present invention.

In U.S. Pat. No. 2,832,628, dated Apr. 29, 1958, Turnbull disclosed an improved lifter for loosening and lifting manhole covers. The principal object of the invention is to provide a simple, strong and sturdy manhole cover lifter, which will loosen and lift manhole covers of different sizes and weights. The lifter comprises an operating level which can be operated by one man to loosen the cover, lift it up and swing it laterally away from the manhole.

In U.S. Pat. No. 6,439,628 B1, dated Aug. 27, 2002, Estambolchi, et al., disclosed a durable cover lifting tool which includes three separate pieces that are mated together to allow for the entire cover to be lifted in one motion. A pair of hook arms are inserted over opposing holes in the manhole cover and joined together. A lifting arm is then attached to the joined hook arms and used to remove the cover from the opening.

In U.S. Pat. No. 4,482,182, dated Nov. 13, 2984, Mortensen disclosed a tool which is suitable for lifting a manhole lid that has spaced attachment notches in its top surface. In one embodiment, the tool has a substantially rigid support beam. The beam has a first hook adjacent to its forward end which is adapted to be inserted in one of the notches. The beam also has a pivot attachment point adjacent the rear end of the beam. There is provided a second hook which is mounted on the pivot attachment point, the second hook being adapted to be inserted in a second of the notches upon a pivoting of the hook relative to the beam. The hooks will then act to grip the lid between them. To provide a secure grip to grip the lid between them. To provide a secure grip on the lid, there is provided a catch which prevents the second hook from pivoting back out of the second notch until the catch is released. This catch automatically locks the second hook in the second notch upon movement of the second hook into the second notch.

In U.S. Pat. No. 1,933,384, dated Oct. 31, 1933, Moyian disclosed a device for lifting valve covers, manhole covers, sewer covers, and the like and which is to provide a simple, durable and efficient device of this character which may be manufactured at small cost and is well adapted for the purpose intended.

In U.S. Pat. No. 5,775,674, dated Jul. 7, 1998, Bigham disclosed a lift device for lifting a manhole cover which includes a base and a pole configured to lift the manhole cover when one end of the pole is pressed downward. The length of the pole is adjustable in order to permit easy storage and transportation, and to increase the lift force. Retainers are configured to secure manhole covers to the lift device to permit the lifting of the manhole covers in a manner that their center of mass is kept near the end of the pole.

In U.S. Pat. No. 3,985,338, dated Oct. 12, 1976, Herrmann disclosed a tool for breaking loose a manhole cover which has become sealed under an accumulation of road tar and dirt, the device consisting of a long lever which at one end has a hook for engaging an opening through the manhole cover, a fulcrum being located relatively close to the end of the lever having the hook, so that when a workman places his foot upon the other end of the lever, he can with very little effort pry the manhole upwardly for easy removal.

In U.S. Pat. No. 4,157,810, dated Jun. 12, 1979, Haller, et al., disclosed an apparatus for lifting a manhole cover which comprises (1) a means for engaging the manhole cover which cooperates with a lever means for raising the cover, and (2) a pivot means which also cooperates with the level means to pivot the cover to the desired position.

In U.S. Pat. No. 4,365,925, dated Dec. 28, 1982, Girtz disclosed a manhole cover lifter comprising an elongate inclined lever with a handle at its upper end and a fastener at its lower end for attaching to the cover of a manhole; a depending strut intermediate the ends of the lever and a pair of wheels mounted at the lower end of the strut and on a transverse axis forming a fulcrum for the lifting lever; a lifter bar connecting the wheel axle with the forward end of the lifter bar, the lifting lever being of tubular steel and a stiffener bar in the tubular level at the upper end of the depending strut; and a handle at the upper end of the lifting lever.

While these lifters for manhole covers may be suitable for the purposes for which they were designed, they would not be as suitable for the purposes of the present invention, as hereinafter described.

SUMMARY OF THE PRESENT INVENTION

The present invention discloses a lifter for a manhole cover which has an elongated arm having a handle on one end for being grasped and lifted upwardly by a user and on the other end a pair of hooks for placement on or under the edge of the manhole cover. Disposed intermediate the ends of the handle is a slidable downwardly extending hook member which is for placement on the side of the manhole cover opposite to the side of the manhole cover where the hooks are placed. The downwardly extending hook member is slidable along the handle so that the present invention will fit any size of manhole cover. Also disposed on the handle is a clip which locks the downwardly extending hook member in place along the handle for storage.

An object of the present invention is to provide a simple and economical lift for a manhole cover. A further object of the present invention is to provide a lifter which is adjustable to fit any manhole cover. A further objective of the present invention is to provide a device which allows a user to lift a manhole cover without having to bend down to the manhole cover.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
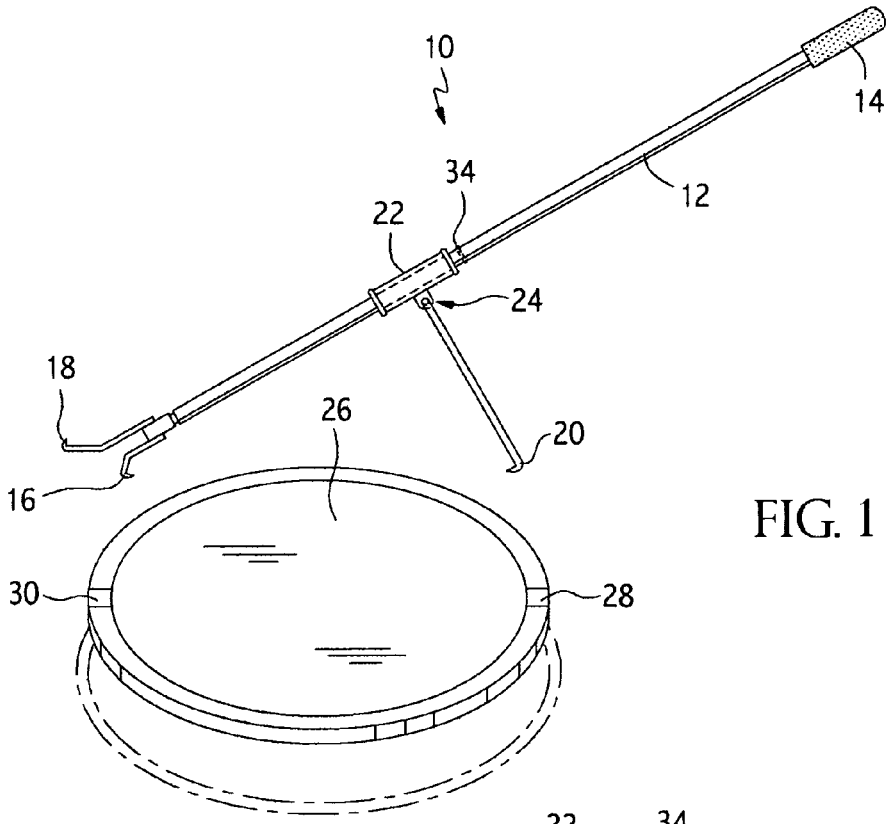
FIG. 1 is a perspective view of the present invention.

With regard to reference numerals used, the following numbering is used throughout the drawings.

10 present invention
12 arm
14 handle
16 hook
18 hook
20 elongated hook member
22 sliding sleeve
24 pivot
26 manhole cover
28 point one
30 point two
32 clip
34 stop

DETAILED DESCRIPTION OF THE PREFERRED EMBODIMENT

Turning now descriptively to the drawings, in which similar reference characters denote similar elements throughout the several views, wherein FIGS. 1 through 4 illustrate the present invention wherein a lifter for a manhole cover is disclosed.

Turning to FIG. 1, shown therein is the present invention 10 having an arm 12 having a first end with a handle 14 on it and a second end with a pair of hook members 16, 18 thereon. Also shown is a sliding sleeve 22 having a downwardly extending hook member 20 attached thereto using a pivot 24. Stop member 34 is also shown for preventing sleeve 22 from sliding too far up the arm 12; stop 34 may be a pin passing through arm 12. Also shown is the manhole cover 26 having a first attachment point 28 and an opposite second attachment point 30. In operation, one of the hooks 16, 18 is attached to one point 28 of the manhole cover 26 and the downwardly extending hook 20 is attached to the opposite 30 point on the manhole cover 26 so that the manhole cover can be easily lifted by a user grasping the handle 14 and lifing arm 12 upwardly in a lever-like action. Hooks 16, 18 are shaped in two different designs so as to be used on two different types of manhole covers.

Figure 2:
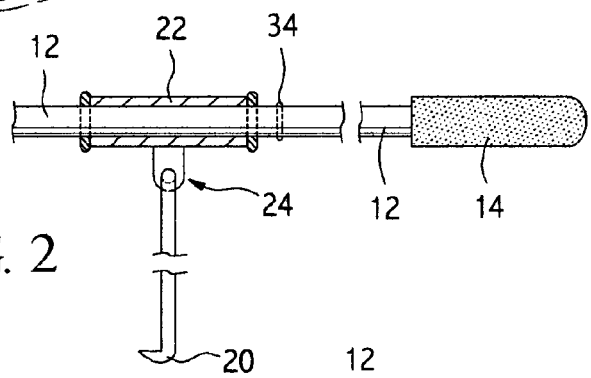
FIG. 2 is a cross-section side view of the slidable hook members of the present invention.

Turning to FIG. 2, shown therein is the present invention 10 having the arm 12, handle 14, sliding sleeve 22, downwardly extending hook member 20 and pivot 24. As can be seen, the sleeve 22 is rotatably, slidably disposed on the arm 12 so that the sleeve can slide up and down and rotate around the arm to allow the present invention 10 to be used with either hook 16 or 18 (not shown) and be adapted to fit any size manhole cover (not shown). Stop 34 is also shown.

Figure 3:
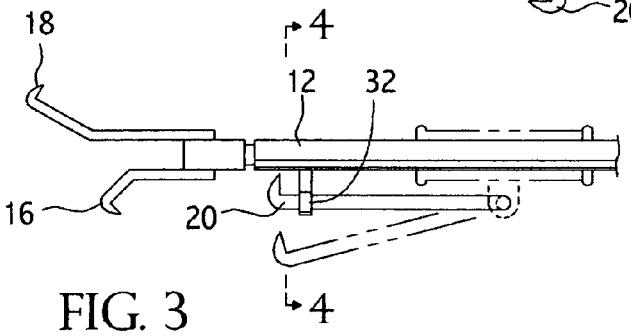
FIG. 3 is an elevation view of the hook members of the present invention.

Turning to FIG. 3, shown therein are the hooks 16, 18 on arm 12 along with a U-shaped, flexible, frictional clip member 32 which is attached to the arm 12 and positioned on the arm so that the distal end of the hook member 20 can be slipped into the clip so as to hold the hook member 20 firmly against the arm when the arm is in a stored position. The clip 32 may be welded or otherwise attached to arm 12.

Figure 4:
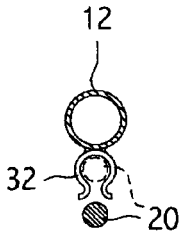
FIG. 4 is a cross section view taken through parts of the present invention.

Turning to FIG. 4, therein is shown arm 12 having clip 32 mounted thereon. Hook member 20 is shown being placed inside the clip 32 so that member 20 can be secured to the arm 12 for storage.

I claim:

1. A lifter for a manhole cover, comprising:

a) an elongated arm having first and second opposing ends;

b) a handle being disposed on said first end of said arm so that a user can grasp said handle and lift the manhole cover;

c) at least one first hook being disposed on said second end of said arm so that said first hook can be attached to a first point on the manhole cover;

d) a second hook member adapted for sliding attachment to said arm, said second hook member being disposed between said first and second ends of said arm so that said second hook member can be attached to a second point on the manhole cover so that a user can grasp the handle and lift the manhole cover;

e) said second hook member having a first and second end, said first end having said second hook member thereon and said second end being pivotally attached to said arm;

f) a slidable, rotatable sleeve mounted on arm, wherein said second end of said second hook member pivotally attaches to said sleeve, said sleeve being disposed between said first and second end of said arm; and, g) a stop being disposed between said sleeve and said first end of said arm so that said sleeve only moves a pre-selected distance along said arm before being stopped by said stop.

2. The lifter of claim 1, wherein said second hook member is a downwardly extending hook member.

3. The lifter of claim 1, further comprising a third hook being disposed on said second end of said arm, wherein said third book is disposed on an opposite side of said arm from said first hook so that said third hook can be attached to a first point on the manhole cover.

4. The lifter of claim 3, wherein said first hook has a first shape for use within a first type of manhole cover and said third hook has a second shape for use with a second type of manhole cover.

5. The lifter of claim 1, further comprising a clip member being disposed on said arm so that said first end of said second hook member can be placed therein for storage.

6. The lifter of claim 1, wherein said stop comprises a pin disposed on said arm.

* * * * *